US010746454B2

(12) United States Patent
Hosamani et al.

(10) Patent No.: US 10,746,454 B2
(45) Date of Patent: Aug. 18, 2020

(54) HOUSEHOLD REFRIGERATION APPLIANCE HAVING A MULTIPLE-PART EXTERNAL HOUSING OF AN ICEMAKER

(71) Applicant: BSH HAUSGERAETE GMBH, Munich (DE)

(72) Inventors: Prashantagouda Hosamani, Ulm (DE); Hans Gerd Keller, Giengen (DE); Robert Stahl, Herbrechtingen (DE)

(73) Assignee: BSH Hausgeraete GmbH, Munich (DE)

( * ) Notice: Subject to any disclaimer, the term of this patent is extended or adjusted under 35 U.S.C. 154(b) by 153 days.

(21) Appl. No.: 15/714,331

(22) Filed: Sep. 25, 2017

(65) Prior Publication Data

US 2018/0087818 A1 Mar. 29, 2018

(30) Foreign Application Priority Data

Sep. 28, 2016 (DE) ..... 10 2016 218 644

(51) Int. Cl.

| | |
|---|---|
| ***F25C 5/20*** | (2018.01) |
| ***F25C 5/185*** | (2018.01) |
| ***F25D 21/14*** | (2006.01) |
| ***F25D 23/06*** | (2006.01) |
| ***F25D 23/12*** | (2006.01) |

(52) U.S. Cl.

CPC ..... *F25C 5/22* (2018.01); *F25C 5/185* (2013.01); *F25C 5/24* (2018.01); *F25D 21/14* (2013.01); *F25D 23/062* (2013.01); *F25D 23/066* (2013.01); *F25D 23/12* (2013.01); *F25C 2400/10* (2013.01); *F25D 2500/02* (2013.01)

(58) Field of Classification Search

CPC .... F25C 5/22; F25C 5/24; F25C 5/185; F25C 2400/10; F25D 21/14; F25D 23/062; F25D 23/066; F25D 23/12; F25D 2500/02

See application file for complete search history.

(56) References Cited

U.S. PATENT DOCUMENTS

| | | | | |
|---|---|---|---|---|
| 2004/0261442 | A1* | 12/2004 | Chung | F25C 5/046 62/344 |
| 2006/0090496 | A1* | 5/2006 | Adamski | F25C 5/005 62/344 |
| 2011/0000248 | A1 | 1/2011 | Jeong et al. | |
| 2013/0263620 | A1 | 10/2013 | An et al. | |
| 2013/0298404 | A1 | 11/2013 | An et al. | |

FOREIGN PATENT DOCUMENTS

EP 2650628 A2 10/2013

* cited by examiner

*Primary Examiner* — Eric S Ruppert
*Assistant Examiner* — Hans R Weiland
(74) *Attorney, Agent, or Firm* — Laurence A. Greenberg; Werner H. Stemer; Ralph E. Locher

(57) ABSTRACT

A household refrigeration appliance has a housing in which there is formed at least one receiving space for food, and an icemaker. The icemaker has an external housing formed from a plurality of separate constituent parts. Wherein one of the constituent parts is a one-piece bottom tray that has a bottom wall and side walls that are integrally formed in one piece thereon.

15 Claims, 4 Drawing Sheets

HOUSEHOLD REFRIGERATION APPLIANCE HAVING A MULTIPLE-PART EXTERNAL HOUSING OF AN ICEMAKER

CROSS-REFERENCE TO RELATED APPLICATION

This application claims the benefit, under 35 U.S.C. § 119, of German patent application DE 10 2016 218 644.2, filed Sep. 28, 2016; the prior application is herewith incorporated by reference in its entirety.

BACKGROUND OF THE INVENTION

Field of the Invention

The invention relates to a household refrigeration appliance having a housing in which there is formed at least one receiving space for food. The household refrigeration appliance moreover includes an icemaker.

Household refrigeration appliances for storing and preserving food, for example refrigerators or freezers or combined fridge-freezers, may also have an icemaker that is configured to produce shaped ice elements such as ice cubes or crushed ice. An icemaker of this kind may be part of a dispenser unit that is configured to discharge these shaped ice elements. The dispenser unit may additionally be configured to discharge liquid, in particular chilled beverages.

A corresponding household refrigeration appliance is known for example from U.S. patent disclosure No. 2011/0000248 A1. The icemaker is arranged in an upper corner region and in this case is arranged in an inset region of the internal container of the household refrigeration appliance.

Furthermore, published European patent application EP 2 650 628 A2 (corresponding to U.S. patent publication Nos. 2013/0263620 and 2013/0298404) discloses a household refrigeration appliance in which the icemaker also has an external housing in which further components, such as an ice shaping dish and a receiving container for shaped ice elements, are arranged. Thus, the external housing forms the outer shell of the icemaker and in this context delimits the internal volume in which these further components of the icemaker are arranged.

However, because of the complex geometry and corresponding further structuring work, this external housing is difficult to make in one piece, so manufacturing tolerances apply here that may then also result in disadvantages during assembly.

Moreover, embodiments are known in which this external housing is formed from two half shells joined together, in which case the join point is formed by a top wall and a bottom wall. These two half shells are thus arranged next to one another, as seen in the horizontal direction, and are connected to one another at the top and bottom, as seen in the vertical direction. This has significant disadvantages in respect of sealing in the lower region, with the result that any liquid occurring can escape undesirably from the external housing.

SUMMARY OF THE INVENTION

It is the object of the present invention to provide a household refrigeration appliance in which a multiple-part external housing of the icemaker takes an improved form in respect of sealing.

A household refrigeration appliance according to the invention includes a housing in which there is formed at least one receiving space for food. The household refrigeration appliance moreover includes an icemaker, which has an external housing and is configured to produce shaped ice elements. The external housing is formed from a plurality of separate constituent parts. Thus, the external housing of the icemaker includes a structure containing at least two constituent parts which are thus joined together appropriately. The external housing delimits an internal volume of the icemaker, within which further components of the icemaker can then be arranged. In the joined-together state of the constituent parts, the external housing delimits a cohesive internal volume with no interruptions, and each constituent part then contributes, as an individual wall region, to delimiting this internal volume. It is provided for any engagement between the constituent parts to occur only at points at which the constituent parts are connected, and in other regions for the respective constituent parts to form a wall region that delimits this internal volume in each case only individually and independently of other constituent parts. In a cross section of the external housing parallel to a charging opening of the external housing, the cross sectional contour of the connected constituent parts takes a cohesive form, in particular a rectangular form, in particular being peripherally closed in the peripheral direction of the contour.

In particular, the icemaker is arranged outside the receiving space. In particular, the icemaker is arranged in a hollow or recess in an internal container that delimits the receiving space by means of its walls. The internal container preferably has a hole or aperture through which the icemaker extends by means of its external housing or against which it abuts by means of its rear side. The icemaker is accessible from the front, with the result that it is only accessible when a door that closes the receiving space is open. The icemaker has a front cover that is a front viewing component and forms a wall by which the icemaker is thermally insulated, preferably also from the receiving space. The icemaker is arranged at least such that a wall region, namely the cover, of the icemaker directly delimits the receiving space. In particular, there is provided a receiving space of the icemaker that, by means of its front wall, forms this wall region directly delimiting the receiving space. This front wall is in particular only accessible through a front charging opening of the receiving space. In particular, the icemaker is arranged in the receiving space only by this front wall, and is otherwise arranged outside the receiving space.

An essential idea of the invention can be seen in the fact that, in the joined-together state, the constituent parts delimit a cohesive internal volume of the external housing, and one constituent part of this external housing is a one-piece bottom tray that has a bottom wall and side walls that are integrally formed in one piece thereon. A trough-like construction of this kind makes it possible to provide a construction, specifically in the lower region of the external housing that is free of intersections and joins, with the result that no undesirable escape of liquid occurs from liquid collecting in the external housing. Materials or components that adjoin the external housing are thus not made wet or soaked by liquid, with the result that no undesirable moisture collects even at these points, nor is functioning of these materials and/or components impaired.

Preferably, it is provided for side walls of the bottom tray to come up to at least three edge sides of the bottom wall. In particular, the bottom tray is constructed to be rectangular and thus has four edge sides up to which a respective side wall can then in particular also come in one piece.

As a result of this construction, the escape of liquid that can then collect in the external housing is further improved, since as a result of this, so to speak, corresponding number of side walls overflow or slopping over is also avoided.

Liquid may be produced for example in the rear region of the external housing. In particular, moisture may arise in the region of an evaporator that is used to generate refrigerating energy which is then fed into the external housing.

In a further advantageous embodiment, it is provided for the bottom wall of the bottom tray to be constructed to be obliquely inclined, at least in certain regions, at an upper side facing the receiving volume of the external housing, in particular as seen in the direction of the depth of the household refrigeration appliance being obliquely inclined downward and to the rear. In particular, this inclination is formed in a rear region of the bottom tray. The bottom tray may be constructed in the manner of a gutter, at least in certain regions, on this upper side. As a result of a non-horizontal arrangement of the bottom wall in this manner, it is possible to deliberately guide the liquid that collects in the bottom tray to the lowest point. This further improves undesirable escape of the liquid and it is possible to a quite particular extent to guide the liquid away out of the bottom tray, and thus also out of the external housing, rapidly and deliberately.

It is provided in particular for this obliquely inclined arrangement of the bottom wall to have the lowest point at an edge side at which, so to speak, the highest side wall then also projects upward. As a result, where appropriate it is also possible for liquid to collect in this region of the bottom tray to a relative extent, since these low points also make possible a corresponding accumulation and form a corresponding trough.

Preferably, it is provided for the external housing to have a hood-like cap piece that is constructed separately from the bottom tray and is placed on top of the bottom tray. This hood-like cap piece may be constructed in one piece and thus form a further separate constituent part of the external housing.

In particular, it is provided for the cap piece to be seated on side walls of the bottom tray. As a result, a mechanically stable connection is made purely because of the action of gravity, and a corresponding join is provided, so to speak, at upright, in particular vertically oriented, walls of the bottom tray on the one hand and the cap piece on the other, between these constituent parts. The secure and mechanically stable connection is thus made particularly advantageously at this join too, as a result of which corresponding sealing is additionally produced here as well.

Preferably, it is provided for a strip-shaped coupling web to be constructed on an upper edge of a side wall of the bottom tray, arranged to abut flat and overlap with a coupling web that is constructed on the cap piece on a vertically oriented side wall when these two separate parts are in the joined-together state. This further improves the above-mentioned advantages, and improves a stabilizing mounting of the two components in the joined-together state.

In particular, it is provided for the strip-shaped coupling web at an upper edge of the side wall of the bottom tray to be a partial element of an insertion slot that is formed on this upper edge. It is then possible to insert the coupling web that is formed on the lower edge of the cap piece into this insertion slot. This further improves the above-mentioned advantages.

In a preferred embodiment, it is provided for there to be formed on an upper edge of a side wall of the bottom tray a tooth structure that meshes with a counter-tooth structure formed on the cap piece, in particular on a lower edge of a hood part of the cap piece. This provides a particularly stable and indeed foam-tight connection point, which is also a connection that transmits force particularly well. In particular, the tooth structure is formed on a side wall of the bottom tray that faces the wall of the cladding unit.

Reinforcing elements may be constructed on an inner side of the wall of the cladding unit.

Preferably, it is provided for the cap piece to be constructed from at least two hood parts that take the form of constituent parts of the external housing, wherein these separate hood parts each have a top wall and the top walls are connected to one another. In particular, as seen in the vertical cross section these two hood parts take an L shape and an upside-down L shape respectively, and on the one hand are directly connected to one another at these top walls and on the other are connected by in each case vertically oriented wall regions of these hood parts to the bottom tray, in particular being connected at these above-mentioned upper edges of the side walls of the bottom tray.

This specific, at least three-part construction of the external housing creates a modular element that is in itself of a very stable construction, can be manufactured to a precise shape and can be assembled quickly and simply.

Particularly advantageously, it is provided for a drain to be integrated into the one-piece bottom tray and thus also to be constructed in one piece within the bottom tray. As a result, any liquid occurring may be guided away out of the bottom tray in a targeted manner.

In particular, it is provided for this drain to be directed appropriately such that when the liquid is guided away out of the bottom tray no other components and/or materials that could be damaged by this liquid are made wet.

Preferably, it is provided for the external housing to be clad, at least on an outer side of a first constituent part and on an outer side of a second constituent part, with a thermally insulating cladding unit. This thermally insulates a partial region of this external housing, with this thermal insulation being arranged directly on the external housing itself. The cladding unit is thus fixedly connected to the external housing.

As a result, the external housing itself takes the form of a module that has already been thermally insulated locally by that stage, with the result that this module can already be prefabricated and this prefabricated module can then be further installed, in particular may be deliberately arranged in an inset region of the internal container.

Preferably, these wall regions of the external housing are clad with a thermally insulating cladding unit and then, in the mounted final state of the external housing, face the receiving space. They then preferably form a vertically oriented wall region of this external housing, and a widthwise wall region that thus forms a bottom wall.

The cladding unit is thus preferably of an L shape construction as seen in vertical cross section, and also has a plate-like structure in this regard.

Particularly advantageously, this cladding unit is formed from two wall regions that are arranged such that an intermediate space is formed between them, into which thermally insulating material, in particular an insulating foam, is introduced. Particularly advantageously, it is provided here for one of these wall regions of the cladding unit to be itself formed by at least one constituent part of the external housing, in which case this constituent part also directly delimits the internal volume of the external housing. In particular, this wall region may be formed by a wall region of the cap piece, in particular a hood part. In particular, this wall region is formed by a vertically oriented wall region of this hood part.

There is then connected to this wall region an outside wall region of the cladding unit in order to form this intermediate space. A corresponding arrangement may then also be provided for the bottom wall, in which case the bottom tray then in particular forms the inner wall region of the cladding unit and in turn a wall that is separate therefrom and an outer separate wall region spaced therefrom is provided and these are connected at the join points to this bottom tray in order to delimit the intermediate space of the cladding unit, in order here too to enable correspondingly thermal insulating material to be introduced.

In this case too, it is provided for this additional, so to speak, outer, wall region of the cladding unit to be joined preferably to the inner wall region of the cladding unit, which are formed by the wall regions of constituent parts of the external housing.

In particular, it is provided for a receiving container to be arranged in the external housing for the purpose of receiving shaped ice elements formed by the external housing. The receiving container is in the form of a drawer and may be pushed into and pulled out of the external housing. In particular, the receiving container includes a tray part and a front wall that is arranged on the front thereof. The latter is in particular formed in one piece with the tray part.

Preferably, it is provided for an ice shaping dish, for the purpose of determining the shape of shaped ice elements to be produced, to be arranged in the external housing above the said receiving container for these shaped ice elements.

It may be provided for the shaped ice elements to be discharged by way of a discharging unit of the dispenser unit. The discharging unit may be arranged in a hollow in a door of the household refrigeration appliance, wherein the door closes the receiving space. Even when the door is closed, this discharge of the shaped ice elements is possible by way of the front of this door, in which case the hollow is in particular formed such that a receiving vessel can be stood therein. However, it may also be provided for a discharging unit of this kind not to be provided on the door and for the shaped ice elements to be removed by opening the door that closes the receiving space and removing the receiving container of the icemaker.

In particular, it is provided for the receiving space on which the icemaker is arranged, or by way of which the icemaker is accessible, to be a refrigerator compartment of the household refrigeration appliance. In particular, the household refrigeration appliance moreover includes at least one further receiving space for food that is separated from the above-mentioned first receiving space. This further receiving space is in particular a freezer compartment. It may be provided for the first receiving space to be arranged above the second receiving space, as seen in the vertical direction of the household refrigeration appliance, and for the first receiving space to be relatively large and capable of being closed at the front by two doors that are pivotal independently of one another. The further receiving space is capable of being closed at the front by a door separate therefrom. In particular, this door for closing the further receiving space is part of a drawer that can be pushed into and pulled out of this further receiving space.

The terms "top", "bottom", "front", "rear", "horizontal", "vertical", "direction of depth", "widthwise", "direction of height", etc. are used to specify the positions and orientations that obtain when the appliance is used properly and arranged for use and when an observer stands in front of the appliance and looks in the direction of the appliance.

Further features of the invention become apparent from the claims, figures and the description of the figures. The features and combinations of features mentioned above in the description, and the features and combinations of features mentioned below in the description of the figures and/or shown only in the figures, are not only usable in the combination specified in each case but also in other combinations without departing from the scope of the invention. Embodiments of the invention that are not explicitly shown in the figures or explained but which are apparent from the embodiments that are explained and producible from separate combinations of features should thus be regarded as included and disclosed. Embodiments and combinations of features that thus do not have all the features of an independent claim as filed should thus also be regarded as disclosed. Moreover, embodiments and combinations of features that go beyond the combinations of features set forth when the claims refer back or differ from these should be regarded as disclosed, in particular by the embodiments set forth above.

Other features which are considered as characteristic for the invention are set forth in the appended claims.

Although the invention is illustrated and described herein as embodied in a household refrigeration appliance having a multiple-part external housing of an icemaker, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
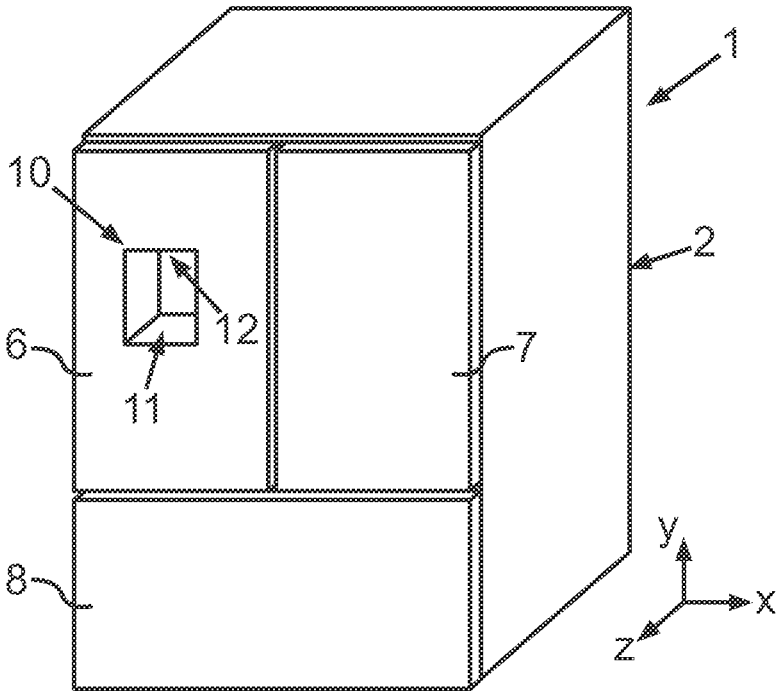
FIG. 1 is a diagrammatic, perspective view of an exemplary embodiment of a household refrigeration appliance according to the invention.

In the figures, like or functionally like elements are provided with the same reference numerals.

Referring now to the figures of the drawings in detail and first, particularly to FIG. 1 thereof, there is shown a schematic illustration of a household refrigeration appliance 1 that is configured for storing and preserving food. The household refrigeration appliance 1 takes the form of a combined fridge-freezer. It includes a housing 2 in which there is constructed a first receiving space 4 (FIG. 2) that is a refrigerator compartment. Furthermore, there is constructed in the housing 2 a second receiving space 5, separate from the first receiving space 4 (FIG. 2), which is a freezer compartment.

As can be seen from FIG. 1, the first receiving space 4 may be closed by two separate doors 6 and 7, which may be actuated independently of one another and are each pivotable in relation to the housing 2 about a vertical axis, which is thus oriented in the direction of height (y direction). The second receiving space 5 may be closed by a door 8 that is itself separate from these. The door 8 may be for example a front wall of a drawer that is mounted such that it can be pushed into and pulled out of the second receiving space 5.

Furthermore, the household refrigeration appliance 1 includes at least one icemaker 9 (FIG. 2), which is arranged outside the first receiving space 4 and thus outside the refrigerator compartment, and is configured to produce shaped ice elements, such as ice cubes or crushed ice.

In particular, the exemplary embodiment provides for the household refrigeration appliance 1 to have a dispenser unit that is configured to discharge at least shaped ice elements. A dispenser unit 10 (FIG. 1) may additionally also be configured to discharge liquid, in particular water or other beverages, in particular mixed beverages. The exemplary embodiment provides for the dispenser unit 10 to be constructed for discharge through the door 6, so that shaped ice elements or liquid can still be discharged in the closed state of the door 6. For this purpose, the door 6 includes a hollow 11 in which a receiving vessel, in particular a drinking vessel, can be stood, with the result that the appropriate medium can be discharged through a discharging unit 12 that is part of the dispenser unit 10 and is arranged in the door 6 and opens into the hollow 11.

However, it may also be provided for discharge of this kind through the door 6 not to be provided and for example only the icemaker 9 to be provided, in which case it is only accessible by opening the door 6. Shaped ice elements that are produced can then be removed by taking out a receiving container (to be described in more detail below) that is part of the icemaker 9 and in which the shaped ice elements collect.

Figure 2:
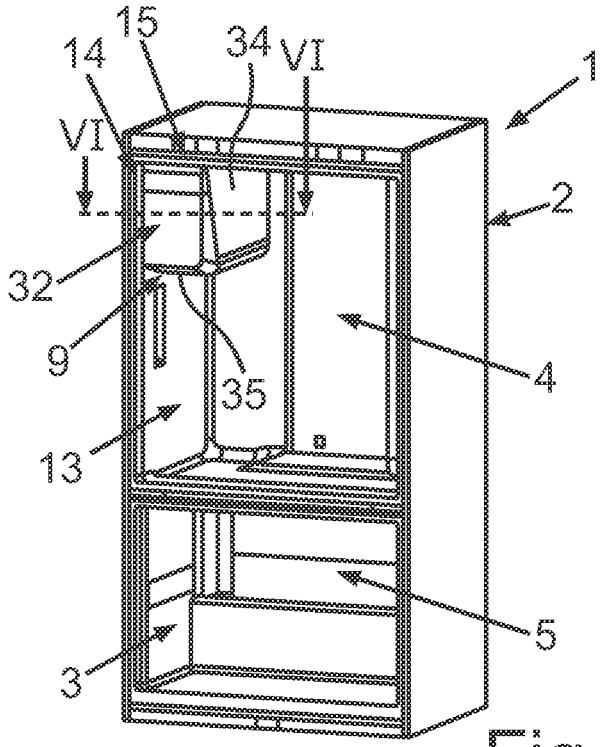
FIG. 2 is a perspective view as in FIG. 1, without doors that are shown in FIG. 1.

As can be seen from FIG. 2, the first receiving space 4 is delimited by walls of an internal container 13. The internal container 13 includes, in its top left corner region 14, an inset region 15 into which the icemaker 9 is inserted. The icemaker 9 is only accessible through the charging opening of the first receiving space 4. The icemaker 9 extends into the receiving space 4 in particular only in certain regions, and thus through at least one aperture or hole in the internal container 13 that delimits the receiving space 4 by means of its walls. The icemaker 9 is arranged at least such that a wall region, in particular a cover, of the icemaker 9 directly delimits the receiving space 4. In particular, there is provided a receiving container of the icemaker 9 that, by means of its front wall, forms this wall region directly delimiting the receiving space 4. This front wall is in particular only accessible through a front charging opening of the receiving space 4.

The second receiving space 5 is likewise delimited by walls of a further internal container 3.

Figure 3:
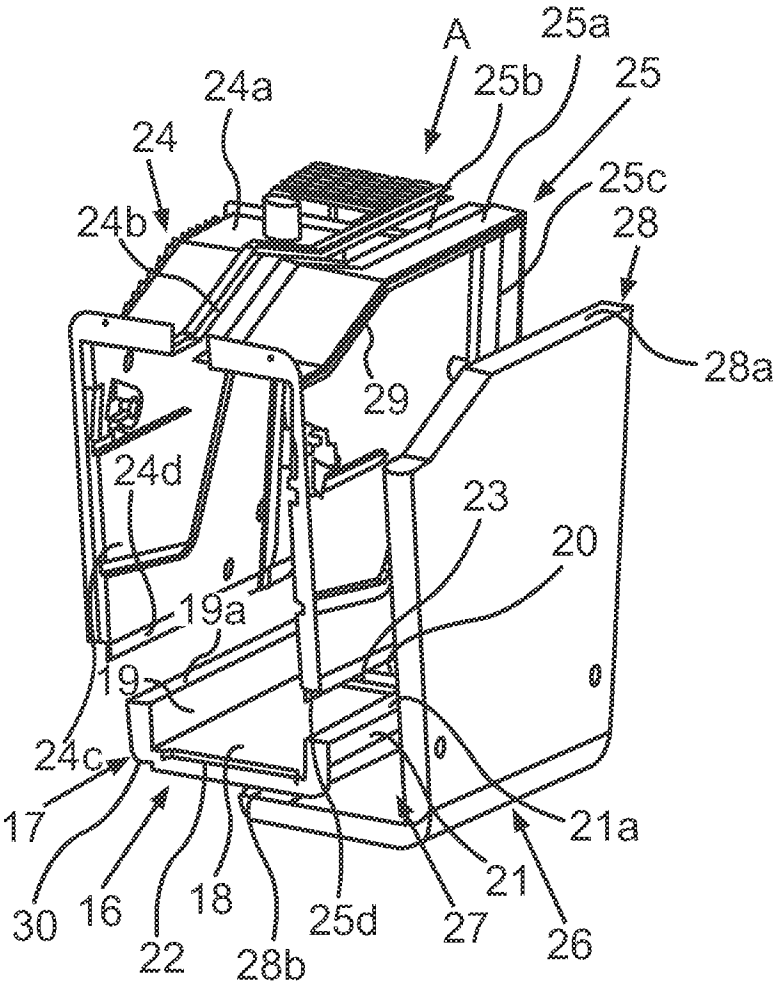
FIG. 3 is a perspective exploded illustration of an exemplary embodiment of an external housing of an icemaker of the household refrigeration appliance in FIG. 1 and FIG. 2, with in addition a thermally insulating cladding unit.

FIG. 3 shows an exploded illustration of an external housing 16 of the icemaker 9. The external housing 16 has a plurality of separate constituent parts. In the joined-together state of the constituent parts, the external housing 16 delimits an internal volume in which a receiving container is arranged displaceably for the purpose of receiving shaped ice elements. Moreover, there is then also arranged in this external housing 16 an ice shaping dish that is designed to predetermine the shape of the shaped ice elements to be produced and is arranged above the receiving container, as seen in the direction of height (y direction) of the household refrigeration appliance 1.

The internal volume that is delimited by the external housing 16 takes a form that is cohesive and thus has no interruptions, and is delimited directly by the walls of the constituent parts. Delimitation of this internal volume of the external housing 16 is in this case such that the inner sides of the constituent parts each form, seen in themselves and individually, individual wall regions that delimit this internal volume. Only at join points, at which the constituent parts of the external housing 16 are joined, may there be an overlap and abutment of the constituent parts with one another; otherwise, other wall regions of the constituent parts do not overlap.

A one-piece bottom tray 17 is provided as a constituent part of the external housing 16. The bottom tray 17 includes a bottom wall 18, which is in particular rectangular, and side walls 19, 20, 21 that come up in one piece to edge sides of the bottom wall 18. Moreover, the bottom wall 18 is not arranged horizontally but is inclined in its position. It runs obliquely down toward the rear side wall 20, with the result that a front edge 22 of the bottom wall 18 is arranged higher up, as seen in the direction of height, than an opposite rear edge 23 of this bottom wall 18.

Furthermore, the external housing 16 includes a further separate constituent part in the form of a hood part 24. Furthermore, a further separate constituent part in the form of a second hood part 25 is provided. The two hood parts 24 and 25 form a cap piece A that is placed on the bottom tray 17 from above and thus covers it, so to speak, from above. These three parts form the external housing 16 and correspondingly delimit the internal volume. As can be seen from FIG. 3, the two hood parts 24 and 25 respectively take the form, in a vertical section, of an L shape (and an inverted L) and may be joined at top walls 24*a* and 25*a*, as can be seen from the joined-together illustration in FIG. 4. For this purpose, the top wall 24*a* has a strip-shaped coupling web 24*b*. The top wall 25*a* likewise includes a strip-shaped coupling web 25*b*, wherein in the joined-together state of the hood parts 24 and 25 these two coupling webs 24*b* and 25*b* overlap. In particular, one of the two coupling webs 24*b* or 25*b* is a partial region of an insertion slot into which the other coupling web may then be inserted.

Figure 4:
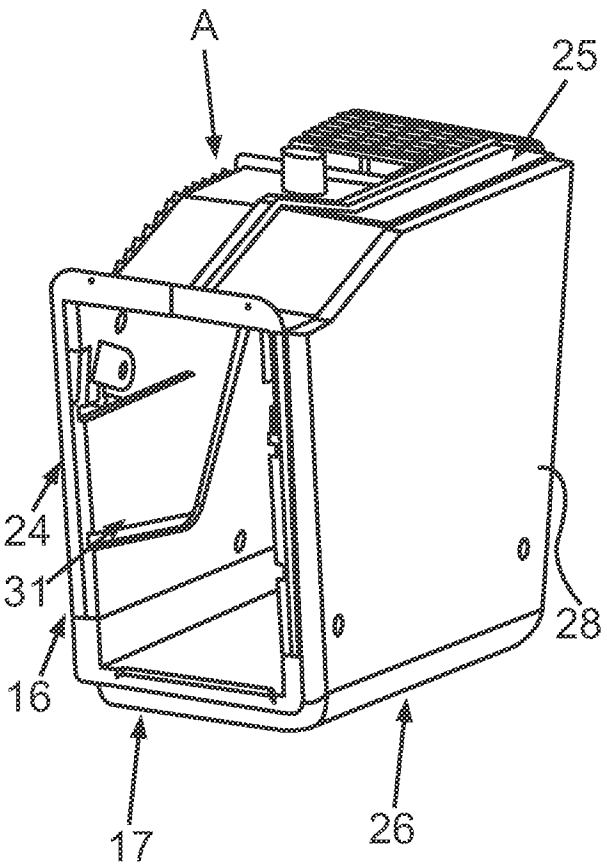
FIG. 4 is a perspective view as in FIG. 3 in the joined-together state.

Furthermore, it is provided for likewise strip-shaped coupling webs 24*d* and 25*d* to be constructed on lower edges of vertical walls 24*c* and 25*c* of these hood parts 24 and 25. These also overlap in the joined-together state, as shown in FIG. 4, with a coupling web 19*a* of the side wall 19 and a coupling web 21*a* of the side wall 21. Here too, it may preferably be provided for in each case one of the two coupling webs to be a constituent part of an insertion slot into which the respectively other coupling web may then be inserted.

Furthermore, the icemaker 9 includes a thermally insulating cladding unit 26, which in the exemplary embodiment takes the form of a plate that is L-shaped in vertical section. The cladding unit 26 extends in particular over the entire height of the external housing 16 and in this regard respectively vertical wall regions of the hood part 25 and the side wall 21. Furthermore, the cladding unit 26 also extends completely below the bottom tray 17, such that this is also correspondingly clad from below.

Particularly advantageously, it is provided for the cladding unit 26 to have a shell in which there is formed an intermediate space 27 filled with a thermally insulating material, in particular an insulating foam.

This shell of the cladding unit 26 is formed on the outside by an outer wall 28 that is in particular in one piece. Furthermore, particularly advantageously the shell is formed on the inside by wall regions of the hood part 25 and wall regions of the bottom tray 17. In this context, the wall 28 is then also in turn connected to these wall regions, in particular being pushed together therewith. In particular, it is provided here for there to be made on an upper edge of the hood part 25 an insertion slot 29 into which a top wall 28*a* of the wall 28, facing this insertion slot 29, may be inserted. Accordingly, it is also in particular provided for there to be formed on an underside of the bottom trough 17 a corresponding insertion slot 30 into which a further wall strip 28*b* of the wall 28 may be inserted. It is in particular provided for these insertion slots 29 and 30 to be connected to one another and thus for a preferably peripherally closed insertion slot to be formed into which then corresponding wall regions or wall strips of the wall 28, also in particular peripherally closed, may be inserted. The cladding unit 26 is thus partly formed from wall regions which are at the same time also wall regions of the external housing 16 and thus on the one hand delimit the intermediate space 27 of the cladding unit 26 directly and on the other also at the same time delimit the internal volume of the external housing 16.

As mentioned above, FIG. 4 shows the joined-together state of the component in FIG. 3. The front charging opening 31 of the external housing 16 can be seen. A corresponding receiving container 32 (FIG. 2) can then be pushed in through this charging opening 31. FIG. 2 shows the receiving container 32 in the pushed-in state.

Figure 5:
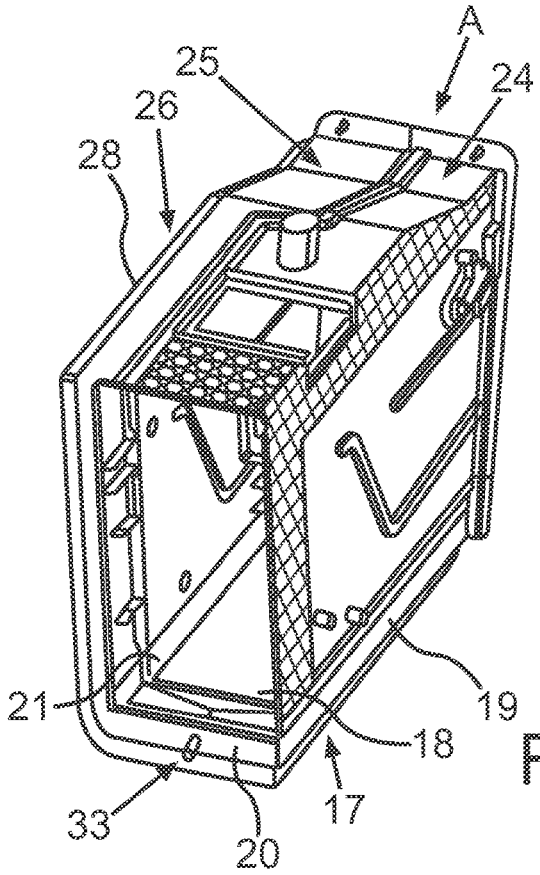
FIG. 5 is a perspective view as in FIG. 4, with a perspective illustration from the rear.

The module from FIG. 4 can be seen in FIG. 5, in a view from the rear. It can be seen that a drain 33 is integrated into the bottom tray 17, in particular being integrated at the rear side wall 20.

Figure 6:
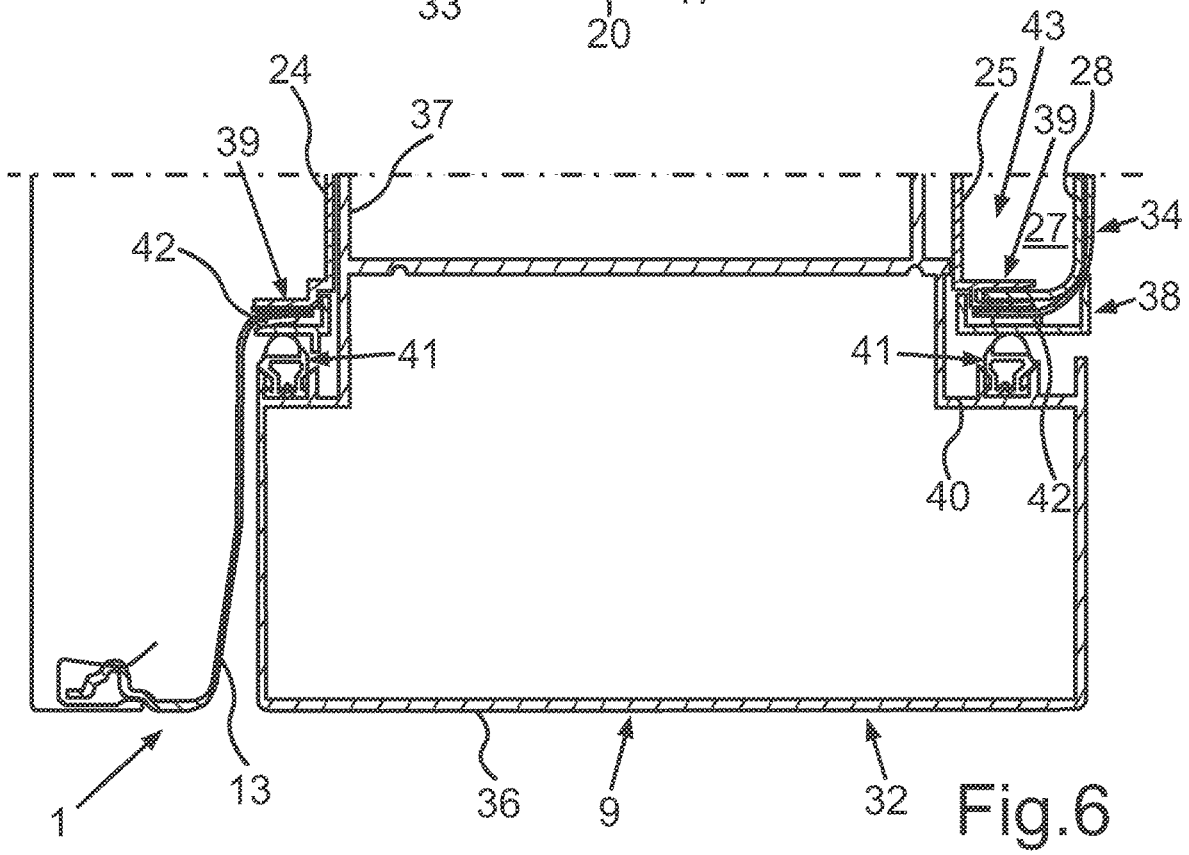
FIG. 6 is a horizontal sectional illustration through the household refrigeration appliance as in FIG. 2, along the line of section VI-VI.

FIG. 6 shows a horizontal illustration, which is thus in an x-z plane, of the household refrigeration appliance 1, along the line of section VI-VI in FIG. 2.

It can be seen here that the external housing 16 is arranged in the inset region 15 such that the cladding unit 26 faces the receiving space 4. However, the cladding unit 26 is not arranged to delimit the receiving space 4 directly, but rather in this context the internal container 13 includes wall regions 34 and 35 (FIG. 1), which in turn cover the cladding unit 26 toward the receiving space 4. In particular, it is provided for the cladding unit 26 to abut directly against these wall regions 34 and 35. This is possible because there is no longer any need to introduce additional thermal insulating material between the cladding unit 26 and these wall regions 34 and 35 in order to thermally insulate the external housing 16 from the receiving space 4: this is already effectively achieved by the thermally insulating cladding unit 26.

FIG. 6 shows a horizontal sectional illustration along the line of section VI-VI in FIG. 2 of the household refrigeration appliance 1, in the region of the icemaker 9. It can also be seen from FIG. 6 that, preferably, a peripheral frame 38 that delimits the charging opening 31 is provided, at the front side whereof, and facing this front side, there is arranged a rear side 40 of a front wall 36 of the receiving container 32 of the icemaker 9, in particular a peripheral sealing element 41 that abuts against the front side when the receiving container 32 is in the closed state.

The receiving container 32 includes a tray part 37 beside the front wall 36 and in particular connected in one piece thereto. As can likewise be seen, the hood part 25 is connected to the wall 28 at a front edge 39 of the external housing 16, in particular the two being joined together. Between the wall region 34 of the internal container 13 and the frame 38 there is arranged a further, in particular peripheral, sealing element 42. The wall region 34 lies around the front edge 39 in the shape of an arc and extends into the gutter-like region of the frame 38. Thermally insulating material 43, in particular insulating foam, is introduced into the intermediate space 27.

Figure 8:
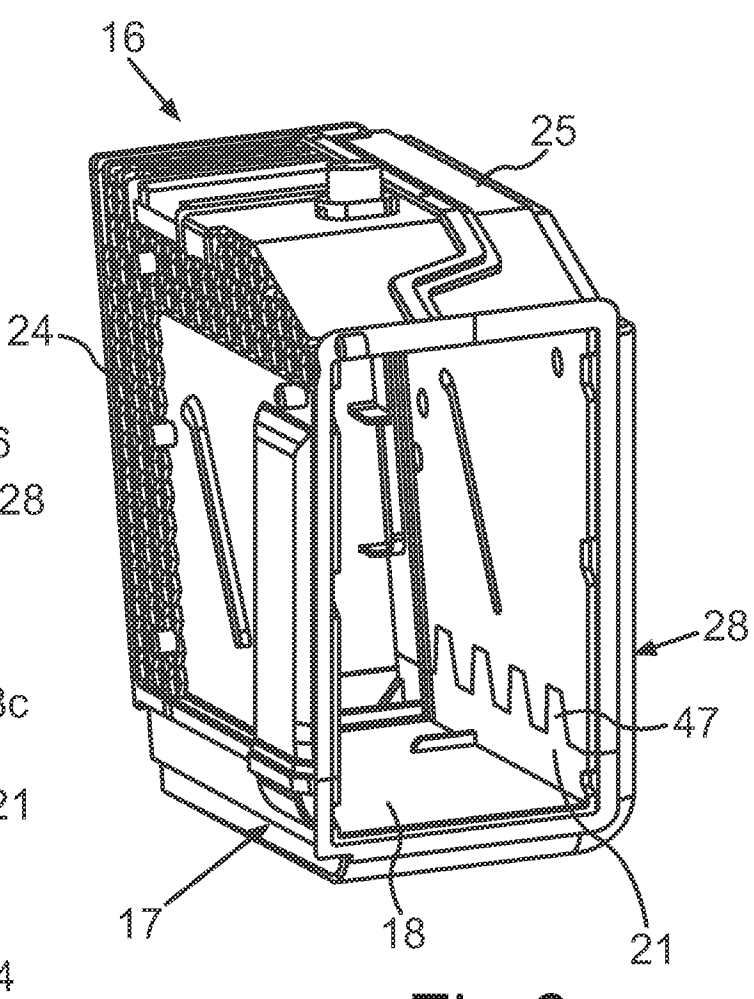
FIG. 8 is a perspective view of the embodiment in FIG. 7 in the joined-together state.
Figure 7:
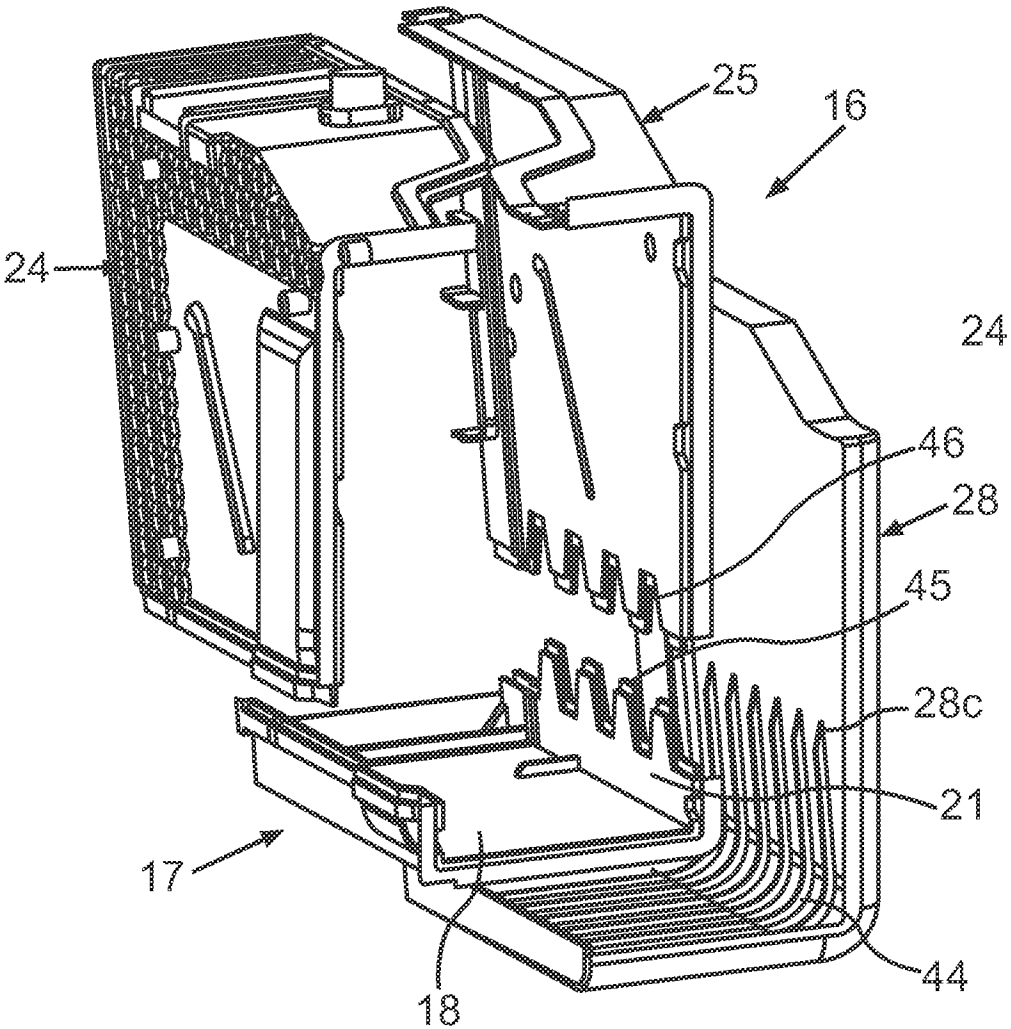
FIG. 7 is an exploded, perspective illustration of a further exemplary embodiment of an external housing.

FIG. 7 shows an exploded illustration of the external housing 16 in a further exemplary embodiment. Here too, the cladding unit 26 is formed in an L shape. In particular, here too the wall 28 is made in one piece and in an L shape. A plurality of reinforcing elements 44, in particular in the form of elongate ribs, are formed in an integrated manner on an inner side 28*c* of the wall 28. The reinforcing elements 44 are oriented parallel to one another and extend in each case cohesively, even over a transition of the L shape between a base limb of the L shape and an upright limb of the L shape. In particular, it is also provided for the bottom tray 17 to have, beside the bottom wall 18, the side wall 21, which faces the wall 28. A tooth structure 45 is formed on an upper edge of this side wall 21. In the joined-together state of the external housing 16, as shown in FIG. 8, this tooth structure 45 meshes with a counter-tooth structure 46 and thus forms a connection point 47. The counter-tooth structure 46 is formed on a lower edge of the hood part 25.

The following is a summary list of reference numerals and the corresponding structure used in the above description of the invention:

1 Household refrigeration appliance
2 Housing
3 Internal container
4 First receiving space
5 Second receiving space
6 Door
7 Door
8 Door
9 Icemaker
10 Dispenser unit
11 Hollow
12 Discharging unit
13 Internal container
14 Left-hand corner region
15 Inset region
16 External housing
17 Bottom tray
18 Bottom wall
19 Side wall
19*a* Coupling web
20 Side wall
21 Side wall
21*a* Coupling web
23 Front edge
23 Rear edge
24 Hood part
24*a* Top wall
24*b* Strip-shaped coupling web
24*c* Vertical wall
24*d* Strip-shaped coupling web
25 Hood part
25*a* Top wall
25*b* Strip-shaped coupling web
25*c* Vertical wall
25*d* Strip-shaped coupling web
26 Thermally insulating cladding unit

27 Thermally insulating material
28 One-piece wall
28*a* Top wall
28*b* Wall strip
28*c* Inner side
29 Insertion slot
30 Insertion slot
31 Charging opening
32 Receiving container
33 Drain
34 Wall region
35 Wall region
36 Front wall
37 Tray part
38 Frame
39 Front edge
40 Rear side
41 Sealing element
42 Sealing element
43 Thermally insulating material
44 Reinforcing element
45 Tooth structure
46 Counter-tooth structure
47 Connection point
A Cap piece
VI-VI Line of section

The invention claimed is:

1. A household refrigeration appliance, comprising:
a housing defining at least one receiving space for food;
an icemaker having an external housing delimiting an internal volume, said external housing including a one-piece bottom tray having a bottom wall and side walls that are integrally formed in one piece on said bottom wall; and
said bottom wall disposed to be obliquely inclined, as seen in a direction of a depth of the household refrigeration appliance being obliquely inclined downward and to a rear.

2. The household refrigeration appliance according to claim 1, wherein said side walls of said one-piece bottom tray come up to at least three edge sides of said bottom wall.

3. The household refrigeration appliance according to claim 1, further comprising a drain integrated into said one-piece bottom tray.

4. A household refrigeration appliance, comprising:
a housing defining at least one receiving space for food;
an icemaker having an external housing delimiting an internal volume, said external housing including a one-piece bottom tray having a bottom wall and side walls that are integrally formed in one piece on said bottom wall; and
said external housing having a hood-shaped cap piece that is placed on top of said one-piece bottom tray.

5. The household refrigeration appliance according to claim 4, wherein said hood-shaped cap piece is seated on said side walls of said one-piece bottom tray.

6. The household refrigeration appliance according to claim 5, wherein:
said hood-shaped cap piece has a coupling web; and
said one-piece bottom tray has a strip-shaped coupling web constructed on an upper edge of one of said side walls of said bottom tray, said strip-shaped coupling web is disposed to abut flat and overlap with said coupling web on said hood-shaped cap piece.

7. The household refrigeration appliance according to claim 5, wherein:
said hood-shaped cap piece has a counter-tooth structure; and
on an upper edge of one of said side walls of said one-piece bottom tray is a tooth structure that meshes with said counter-tooth structure formed on said hood-shaped cap piece.

8. The household refrigeration appliance according to claim 4, wherein said hood-shaped cap piece is constructed from at least two hood parts, said hood parts have top walls and said top walls are connected to one another.

9. The household refrigeration appliance according to claim 8, wherein:
said top walls include a first top wall and a second top wall;
said second top wall has an edge with a second strip-shaped coupling web formed on said edge of said second top wall that faces said first top wall; and
said first top wall has on an edge facing said second top wall, a first strip-shaped coupling web that is disposed to abut flat and overlap with said second strip-shaped coupling web.

10. The household refrigeration appliance according to claim 9, wherein one of said first and second strip-shaped coupling webs is a part of an insertion slot for the other of said first and second strip-shaped coupling web.

11. The household refrigeration appliance according to claim 4, further comprising:
a first constituent part and a second constituent part each having an outer side; and
a thermally insulating cladding unit, said external housing is clad, at least on said outer side of said first constituent part and on said outer side of said second constituent part, with said thermally insulating cladding unit.

12. The household refrigeration appliance according to claim 11,
further comprising a thermally insulating material; and
wherein said thermally insulating cladding unit has a shell by which there is formed an intermediate space into which said thermally insulating material is introduced, said shell is formed by an inner wall, which is formed by wall regions of said hood-shaped cap piece and wall regions of said one-piece bottom tray, and an outer wall connected thereto.

13. The household refrigeration appliance according to claim 11, wherein said thermally insulating cladding unit is in an L shape and said thermally insulating cladding unit is disposed facing said receiving space.

14. A household refrigeration appliance, comprising:
a housing defining at least one receiving space for food;
an icemaker having an external housing delimiting an internal volume, and said external housing including a one-piece bottom tray having a bottom wall and side walls that are integrally formed in one piece on said bottom wall; and
a receiving container disposed in said external housing for receiving shaped ice elements formed in said external housing.

15. The household refrigeration appliance according to claim 14, further comprising an ice shaping dish disposed in said external housing above said receiving container, said ice shaping dish determining a shape of shaped ice elements to be produced.

* * * * *